US005647142A

United States Patent [19]

Andersen et al.

[11] Patent Number: 5,647,142

[45] Date of Patent: Jul. 15, 1997

[54] APPARATUS AND PROCESS FOR DRYING A MOIST MATERIAL DISPERSED OR DISPERSIBLE IN A STREAM OF DRYING GAS

[75] Inventors: Poul Rasmus Andersen, Kvistgård; Ove Emil Hansen, Allerød, both of Denmark

[73] Assignee: Niro A/S, Soborg, Denmark

[21] Appl. No.: 648,517

[22] Filed: May 13, 1996

[51] Int. Cl.[6] ..... F26B 3/08

[52] U.S. Cl. ..... 34/373; 34/487; 34/576; 34/587; 34/182

[58] Field of Search ..... 34/314, 326, 372, 34/373, 487, 576, 582, 583, 587, 594, 182, 227; 110/245

[56] References Cited

U.S. PATENT DOCUMENTS

| | | | |
|---|---|---|---|
| 3,769,922 | 11/1973 | Furlong et al. | 110/245 X |
| 3,821,342 | 6/1974 | Hurd | 264/53 |
| 4,033,555 | 7/1977 | Fong | 259/4 R |
| 4,089,119 | 5/1978 | Heinze | 34/10 |
| 4,446,629 | 5/1984 | Stewart et al. | 34/582 |
| 4,530,290 | 7/1985 | Comparato | 34/576 X |
| 5,143,875 | 9/1992 | Owen et al. | 34/576 X |
| 5,333,392 | 8/1994 | Heinze | 34/363 |

*Primary Examiner*—John M. Sollecito
*Assistant Examiner*—Steve Gravini
*Attorney, Agent, or Firm*—Sughrue, Mion, Zinn, Macpeak & Seas

[57] ABSTRACT

In an apparatus for drying a moist material in a stream of drying gas the residence time is increased by inserting one or more perforated plates, above which fluidized particle layers are created, and through which a portion of the drying gas and material to be dried are passed, whereas the remaining part of the drying gas and material is by-passed said perforated plates. Improved drying capacity, heat economy and operational flexibility and decreased risk for heat damage of the material to be dried are obtained.

36 Claims, 6 Drawing Sheets

APPARATUS AND PROCESS FOR DRYING A MOIST MATERIAL DISPERSED OR DISPERSIBLE IN A STREAM OF DRYING GAS

FIELD OF THE INVENTION

The present invention relates to the field of drying techniques, in which the material to be dried is dispersed into a stream of drying gas, and an essential part of the drying takes place, while the material is entrained by the stream before recovering the material as particles of reduced moisture content in a particle collector means.

BACKGROUND OF THE INVENTION AND PRIOR ART

Many different types of industrial dryers exist or have been suggested. For drying of a specific type of material a single or a few types of dryers will often be more suitable than other types.

For drying semi-wet materials, which can be dispersed as particles in a gas stream and require only a relative short residence time in the stream of drying gas, a so-called pneumatic dryer or flash dryer is suitable. In a flash dryer the product to be dried is pneumatically transported through a flash pipe by the drying gas. The flash dryer is used when the physical properties of a wet material allow it to be dried in a matter of seconds by evenly dispersing it into a stream of heated gas, In the present specification and claims the term gas is used in a broad sense, comprising also atmospheric air, and in fact the drying gas will most often be heated atmospheric air.

The extremely short retention time makes a pneumatic dryer ideal for products having a small particle size with surface moisture, or where any required diffusion to the surface occurs rapidly. Relatively high drying temperatures can be used as the immediate evaporation of the surface moisture cools the particle surface and the drying gas, whereby drying can be accomplished without an appreciable increase of the product temperature. Therefore pneumatic drying can be used also for heat sensitive products.

However, for some products suitable for flash drying the residual moisture level of the product when leaving the dryer is to high. This applies inter alia for some types of polyvinyl chloride (PVC). This necessitates an after-drying of the product to bring the residual moisture level from, for example, approximately 2–5% by weight to, for example, approximately 0.1% by weight. An after-drying of products from other types of dryers such as spray dryer and vortex dryers is also often needed. Such an after-drying is conventionally performed in different types of dryers, e.g. fluid bed dryers, ring dryers or cyclone dryers.

A cyclone dryer is known from U.S. Pat. Nos. 4,089,119 and 5,333,392, incorporated herein by reference.

This dryer consists of a cylindrical vertical vessel having a tangential inlet opening in the bottom part and a tangential outlet to obtain a swirling flow of drying gas and particles to be dried within the vessel. To increase the retention time annular baffle plates are arranged in the interior of the vessel. Each baffle plate has a central opening towards which the plate is preferably inclined. Thereby particulate material, which settles on the upper surface of the baffle plates slides towards the opening to meet the rising stream of drying gas.

Such a dryer can be connected in series after a flash dryer. The advantage of such system is inter alia that only one drying gas is needed when using the same gas for flash drying and for after-drying in the cyclone dryer.

However, even if many baffle plates are used in such a prior art cyclone dryer the residence time for particulate material to be dried is shorter than desired for certain products. When relative long residence times are needed this can be obtained only by minimizing the product rate resulting in an increase of the outlet temperature. As a result drying economy is reduced and also the risk of heat damaging the product increases, and further calling for the need of an external cooling device. Thereby investment cost increases and the operation becomes more complicated and the advantage of using only one gas source is thus obviated.

Additionally, the prior art cyclone dryers of the type described above do not ensure optimal conditions of contact between drying gas and particles to be dried at all stages, since contact conditions between the drying air and particles forming a layer on the annular baffle plates are not optimal and consequently the prolonged residence time for the particles is not reflected in a corresponding water evaporation.

SUMMARY OF THE INVENTION

It is an object of the invention to overcome the above described disadvantages connected to prior art dryers, and to provide a drying apparatus enabling a longer contact time between drying gas and particulate material than possible in the above described prior art cyclone dryer.

It is a further object to provide a dryer apparatus, in which contact conditions between particulate material and drying gas are improved.

It is also an object to provide a drying apparatus being more compact, especially much lower, than prior art cyclone dryers of same capacity.

In one aspect of the invention the apparatus is intended for receiving particulate material to be dried, which is already suspended in the drying air, which apparatus is typically suitable to continue or complete the drying process in the cutlet flow from a flash dryer or spray dryer.

In another aspect, the invention provides an apparatus suitable for drying a moist material, which is dispersed in the drying air only after being introduced into the drying apparatus.

The objects aimed at are achieved by the invention, which provides an apparatus for drying a moist material dispersed or dispersible in a stream of drying gas, comprising a housing; supplying means in the lower part of the housing for drying gas and material to be dried, said means being selected from the group comprising (i) at least one common inlet opening for supplying drying gas entraining the moist material, and (ii) at least one inlet opening for drying gas and at least one inlet for moist material to be entrained in the drying gas after introduction into said housing; in the housing above said supplying means at least one substantially horizontal perforated plate, the perforations of which are dimensioned to allow an upward passage of a portion of the drying gas with entrained material therethrough sufficient to maintain a fluidized particle layer on the upper side of said plate when operating the apparatus, the periphery of said plate substantially being in sealing contact with the housing; for each such plate at least one by-pass means from a location below the plate to a location above the plate for passage of that portion of the drying gas with entrained material, which is not passing said perforations; and in the upper part of the housing above said at least one plate cutlet means for discharging the drying gas entraining the material with reduced moisture content.

The above housing has preferably a vertical, substantially cylindrical wall, thereby being an upright rotation symmetrical vessel, but alternatively the housing may have a polygonal horizontal sectional shape, for example being quadratic, and also a conical shape of the housing comes into consideration.

This apparatus can be operated while maintaining a hold-up mass of powder in the apparatus more than twice as high as that possible using a prior art apparatus of similar size, but with none-perforated baffle plates in stead of the perforated gas distributing plates. This of course corresponds to an increase of residence time by more than 100%.

Inter alia to increase the flow path of drying gas with entrained particles it is preferred to create a swirling motion within the apparatus.

Several means can be applied for this purpose. In a preferred embodiment the means for supplying drying gas is tangential to the cylindrical wall.

In another preferred embodiment the outlet means is tangential to the cylindrical wall in the same sense of rotation as the tangential means for supplying drying gas.

Although a certain residence time improving effect can be obtained using only a single horizontal perforated plate in the apparatus it is generally preferred to have two or more such perforated plates, which during the operation of the apparatus act as air distributing plates enabling maintenance of layers of fluidized particles.

As a supplement to such perforated plates the apparatus can also comprise annular sloping baffles as those used in the prior art apparatuses.

A description of further preferred embodiments will be presented below in connection with the drawings.

The invention also deals with a drying process utilizing a special embodiment of the apparatus as also explained in connection with the drawings.

The process and apparatus according to the invention can be used for drying various materials such as polymers, for example s-PVC or ABS, silica, pigments and starch products.

BRIEF DESCRIPTION OF THE DRAWINGS

In the following the invention is explained in more details with reference to the drawing, wherein.

DESCRIPTION OF PREFERRED EMBODIMENTS

Figure 1:
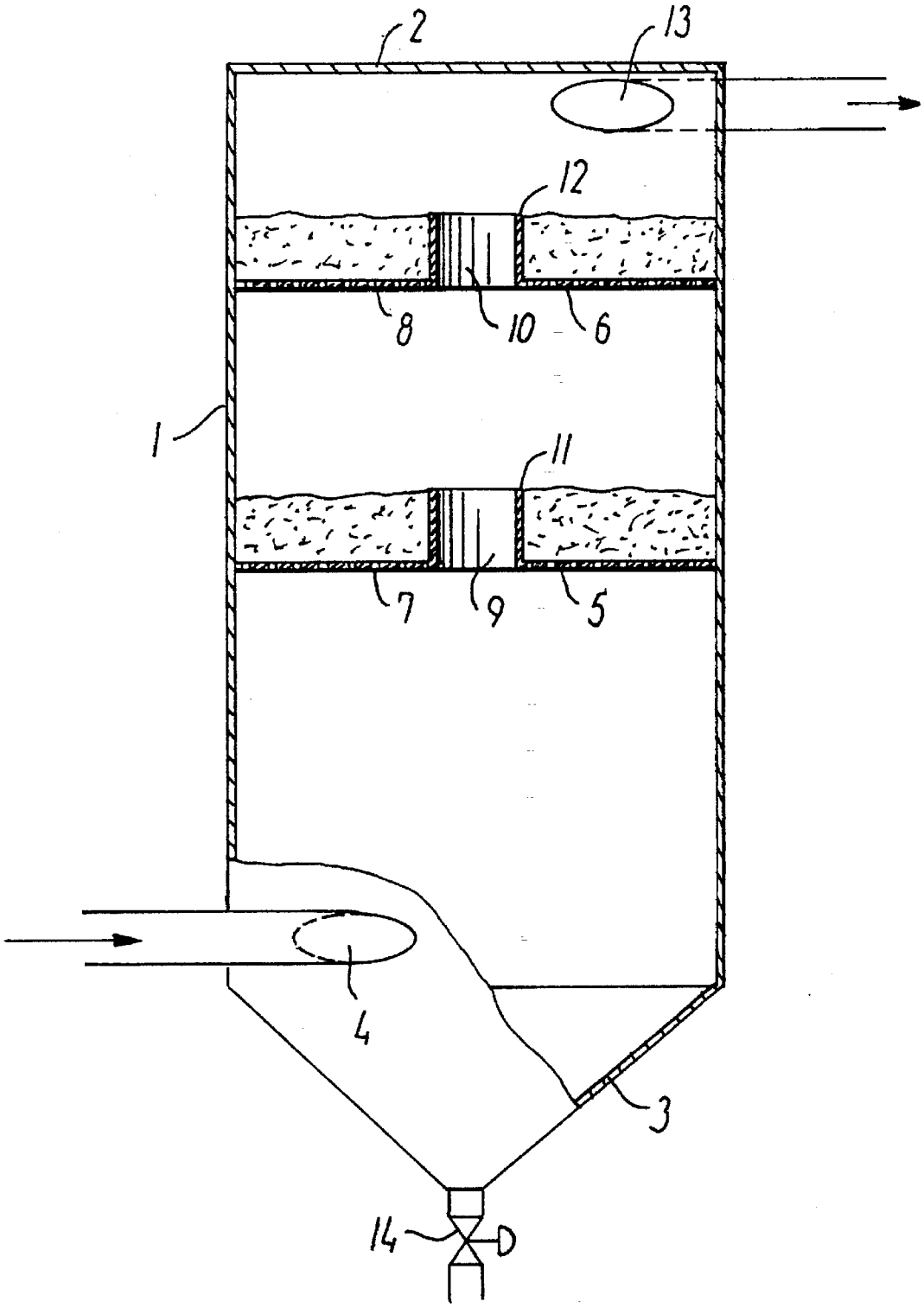
FIG. 1 is a schematic vertical partial sectional view of an embodiment of the apparatus according to the invention.

FIG. 1 illustrates a housing having a vertical cylindrical wall 1, a ceiling 2 and a conical bottom portion 3.

Just above the conical bottom, supplying means 4 is provided. In the embodiment depicted the supplying means is an opening connected to a supply duct for introducing drying gas with particulate material entrained therein into the housing in a direction tangential to the cylindrical wall 1. Typically the supplying means 4 will be connected to the outlet from a flash dryer or spray dryer, meaning that the drying gas introduced through 4 is a gas, which has already been used as drying medium in the flash dryer or the spray dryer, and also the particulate material entrained therein is a product resulting from one of said dryers.

Above the supplying means 4 at least one substantially horizontal perforated plate, in the depicted embodiment two such plates 5, 6 are inserted.

The plates 5 and 6 have perforations 7 and 8 through which a portion of the drying gas with entrained particles introduced through 4 passes in an upward direction.

In the centre of the plates 5 and 6 by-pass means in the shape of apertures 9 and 10 are provided for. That part of the drying gas with entrained particles, which does not pass through the perforations 7 and 8 flows upwards through the apertures 9 and 10, the apertures may be provided with adjustable orifices (not shown).

The apertures 9 and i0 are in the embodiment depicted, encircled by vertical annular walls 11 and 12.

In the upper part of the housing an outlet means for discharging the drying gas entraining the material with reduced moisture content is depicted as an exit opening 13, tangential to the cylindrical wall 1 in the same sense of rotation as the tangential supplying means 4. The outlet means also comprises a duct connected to the opening 13.

At the lowest part of the bottom portion 3, means 14 is provided for removing lumps and large particles, which are not dispersible in the drying gas under the conditions prevailing in the apparatus.

During the operation of the apparatus depicted in FIG. 1 a fluidized particle layer builds up above the perforated plates 6 and 7. The maximum height of the fluidized layer is determined by the height of the annular walls 11 and 12 and particles properties. Particles, which are passing over the walls will be entrained in the upward gas stream through the apertures 9 and 10. The height of the fluidized layer is also influenced by the fact that particles are blown off from the surface of the fluidized layer by the gas stream passing the apertures 9 and 10 and are being deflected by impediment means as explained below.

The existence of the fluidized particle layers is the reason why a much larger amount of particles can be maintained in suitable contact with the drying gas than was possible in prior art apparatuses of similar size having only non-perforated annular baffle plates or flow rings.

The embodiment shown in FIG. 1 with the by-pass apertures placed above each other has the advantage of facilitating introduction of a cleaning nozzle when the apparatus is out of operation. However, it might on the other hand be advantageous to use other locations for the by-pass apertures to obtain a desired extended flow pattern within the apparatus.

The perforations in the plates 5 and 6 can have any suitable shape, but are preferable of the so-called gill type imparting a horizontal component to the direction of the flow of gas and particles penetrating the perforations of the plate.

Gill type plates are well known in the art, see for example U.S. Pat. Nos. 3,821,342 and 4,033,555. The gill-plates may have a combination of "gills" impacting a horizontal component to the direction of flow, and openings which are just vertical bore holes.

In a preferred embodiment these gill-plates direct the penetrating flow tangentially to the cylindrical wall.

In an embodiment in which the means 4 for supplying drying gas is tangential to the cylindrical wall it is preferred to use a gill-plate, which directs the penetrating flow tangentially in the same sense of rotation as the rotation created by the tangential supplying means 4 for drying gas.

Figure 2:
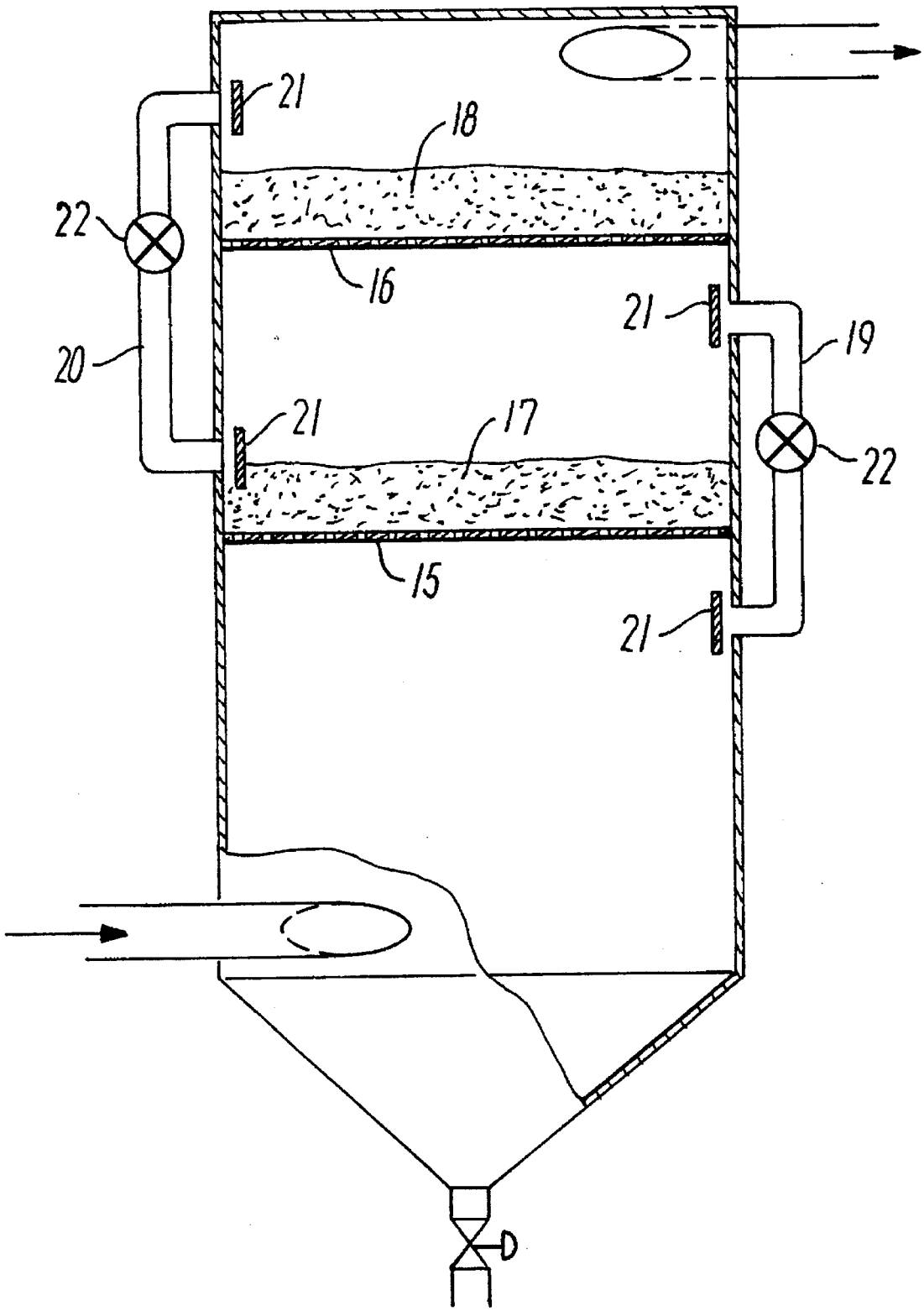
FIG. 2 is a schematic vertical partial sectional view of another embodiment of the apparatus according to the invention.

FIG. 2 shows another embodiment of the apparatus according to the invention, which departs from the embodiment of FIG. 1 mainly by having an external by-pass system instead of the internal by-passes shown in FIG. 1.

In FIG. 2 two perforated plates 15 and 16 are shown, over which fluidized particle layers 17 and 18 are formed during the operation of the apparatus. A by-pass duct 19 connects the area below the perforated plate 15 with the area above the plate, and another by-pass duct 20 connects the area at level with the upper part of the fluidized layer 17 to the area above the perforated plate 16.

That part of the drying gas with entrained particles, which does not pass through the perforated plate 15, is conducted via the by-pass duct 19 to the space between the two perforated plates, and a substantial part of the particles reaches the fluidized layer 17. In this layer the drying process continues and thereby the particles lose weight and some of them will be blown up by the fluidizing gas penetrating the plate 15 and with the air carried through the perforations in the plate 16, and thereby reach the fluidized layer 18. Other particles will reach the layer after having passed the duct 20. In the embodiment depicted impediment plates 21 are arranged at the entrance and exit of each of the by-pass ducts 18 and 20 to influence the general flow pattern and to adjust the ratio between drying gas and particles passing through the perforated plates and the amount passing the by-pass ducts. The position of the impediment plates 21 is preferably adjustable during operation of the apparatus.

As supplement or alternative the flow through the by-pass ducts 19 and 20 can be adjusted by means of dampers 22.

Also the embodiment of FIG. 2 can be supplemented with non-perforated baffle plates of prior art design inserted between and/or above the perforated plates, and the apparatus can have from one to several perforated plates carrying fluidized layers.

The apparatus can also be designed as a combination of the embodiments of FIG. 1 and FIG. 2, which means that by-pass of the perforated plates can take place both through apertures 9 and 10 in the plates and through by-passing ducts outside the wall of the housing 1.

As alternative or supplement to the by-pass means shown in FIG. 1 and 2 the perforated plates may have openings not surrounded by vertical walls, in which case the size of said openings shall be sufficient for the formations of channels through the fluidized layer to enable the desired by-pass flow, but not so large that the formation of a fluidized powder layer is impeded. When operating the apparatus the amount of drying gas by-passing each perforated plate is at least 50%, typically at least 75% of the total amount of drying gas.

Figure 3:
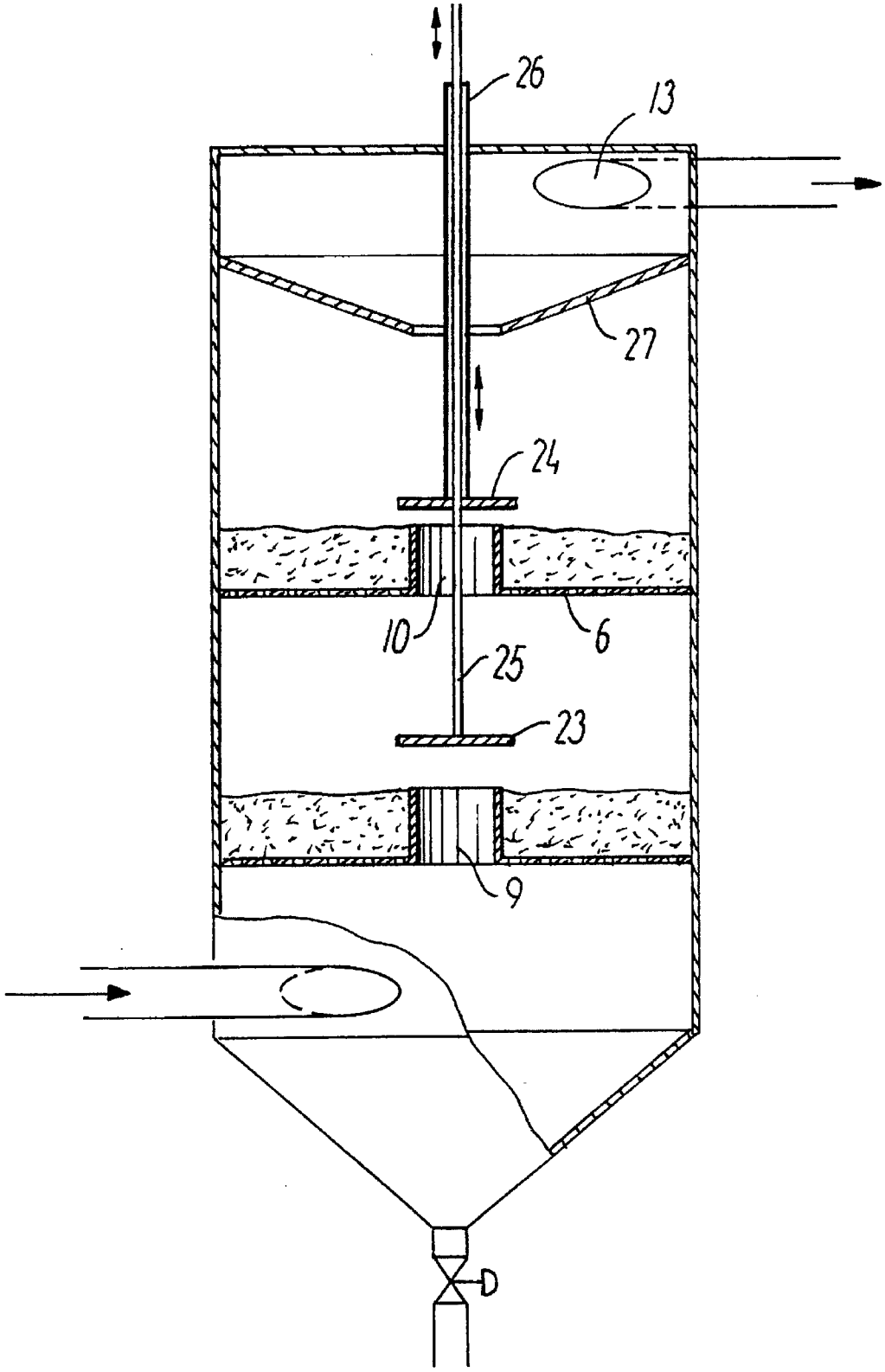
FIG. 3 is a schematic vertical partial sectional view of an embodiment of the apparatus according to the invention similar to the one shown in FIG. 1, but having some further optional details.

FIG. 3 depicts an embodiment similar to the one shown in FIG. 1, but provided with further equipment. Thus above the apertures 9, and 10 in the perforated plates 5 and 6, resp., impediment or damping means 23 and 24 are carried on shafts 25 and 26 to enable individual adjustment of the position of the means 23 and 24 during operation by lifting or lowering the shafts. This adjustment, as well as the adjustment of other means for controlling the operation, may be performed automatically based on monitored process data.

In the upper part of the housing a non-perforated inclining baffle plate 27, also termed flow ring, inserted to impede the direct flow of particles and drying gas from the aperture 10 and the fluidized layer above 6 to the outlet 13 and thereby to further increase residence time for particulate material in the apparatus.

Figure 4:
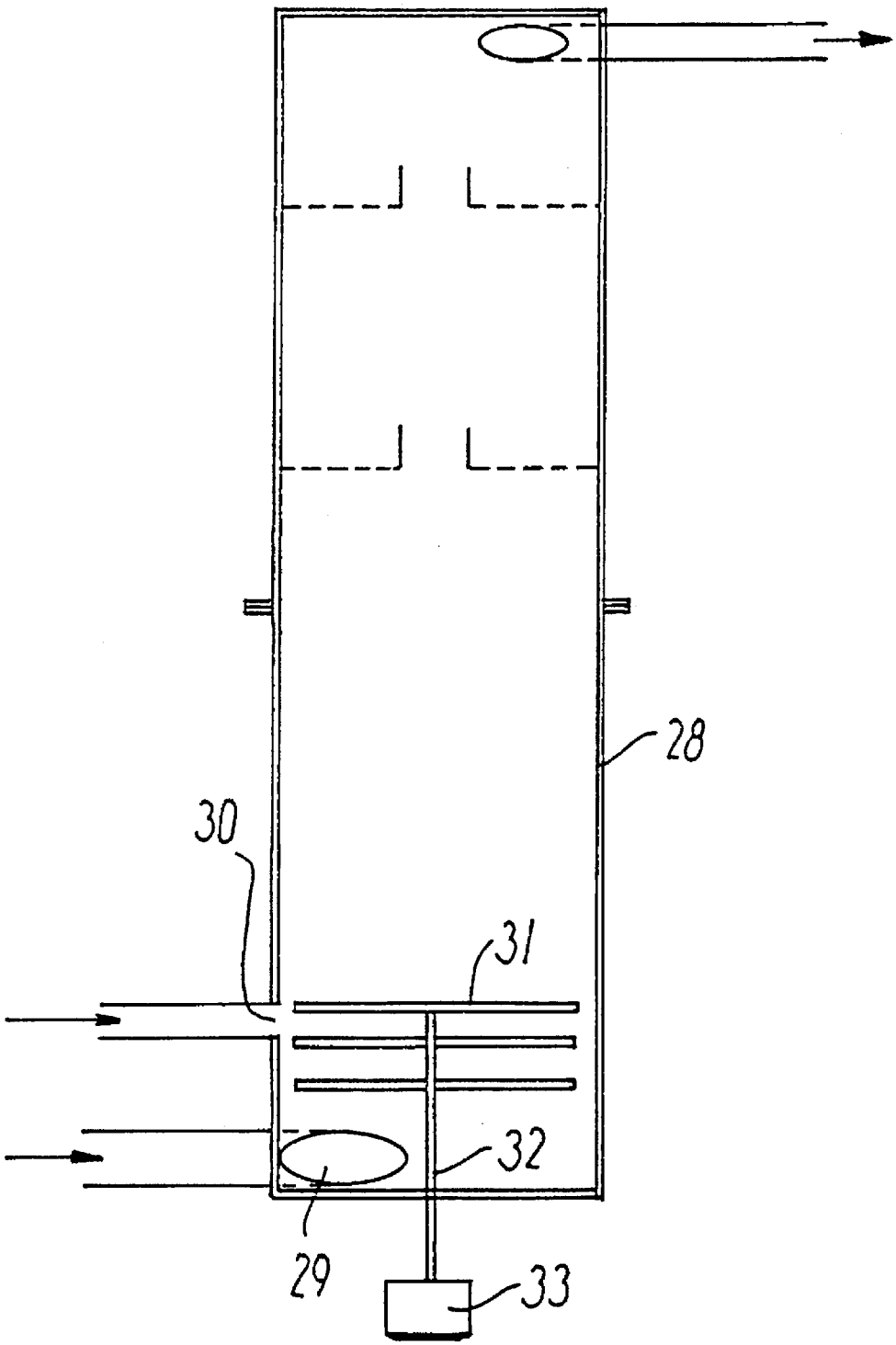
FIG. 4 is a schematic vertical sectional view of an apparatus according to the invention having means for dispersing the material to be dried into the stream of drying gas within the apparatus.

Whereas the embodiments of FIGS. 1–3 are suited for receiving the material to be dried as particles already dispersed in the drying gas, making them especially suitable for after drying using the exit gas from preceding drying steps as drying gas, the embodiment of FIG. 4 is suited for drying a material, which is introduced separately in the apparatus as a moist paste or as moist lumps.

In a housing 28 a preferably tangential inlet 29 for drying gas is arranged near the bottom. At a somewhat higher level above the gas inlet an inlet 30 for moist material is provided. The moist material can for example be fed to said inlet by means of a screw conveyor (not shown).

Between the inlet 30 for moist material and the gas inlet 29 the apparatus has disintegrating means in the shape of bars 31 on a rotatable shaft 32 driven by an electromotor 33 outside the housing. When the moist material is introduced through 30 it will be dispersed by the action of the bars 31 into the upward swirling flow of drying gas and carried to the upper end of the apparatus, which in the depicted embodiment are of a similar design as the one shown in FIG. 1. The apparatus may be operated to achieve a complete drying to the desired level before the material is recovered from the gas stream leaving the top of the apparatus, or an after drying outside the apparatus may be performed reusing the exit gas as drying gas or applying a separate drying gas.

All the embodiments depicted in the various figures may be provided with heating means (not shown) such as external heating jackets or heating elements.

Figure 5:
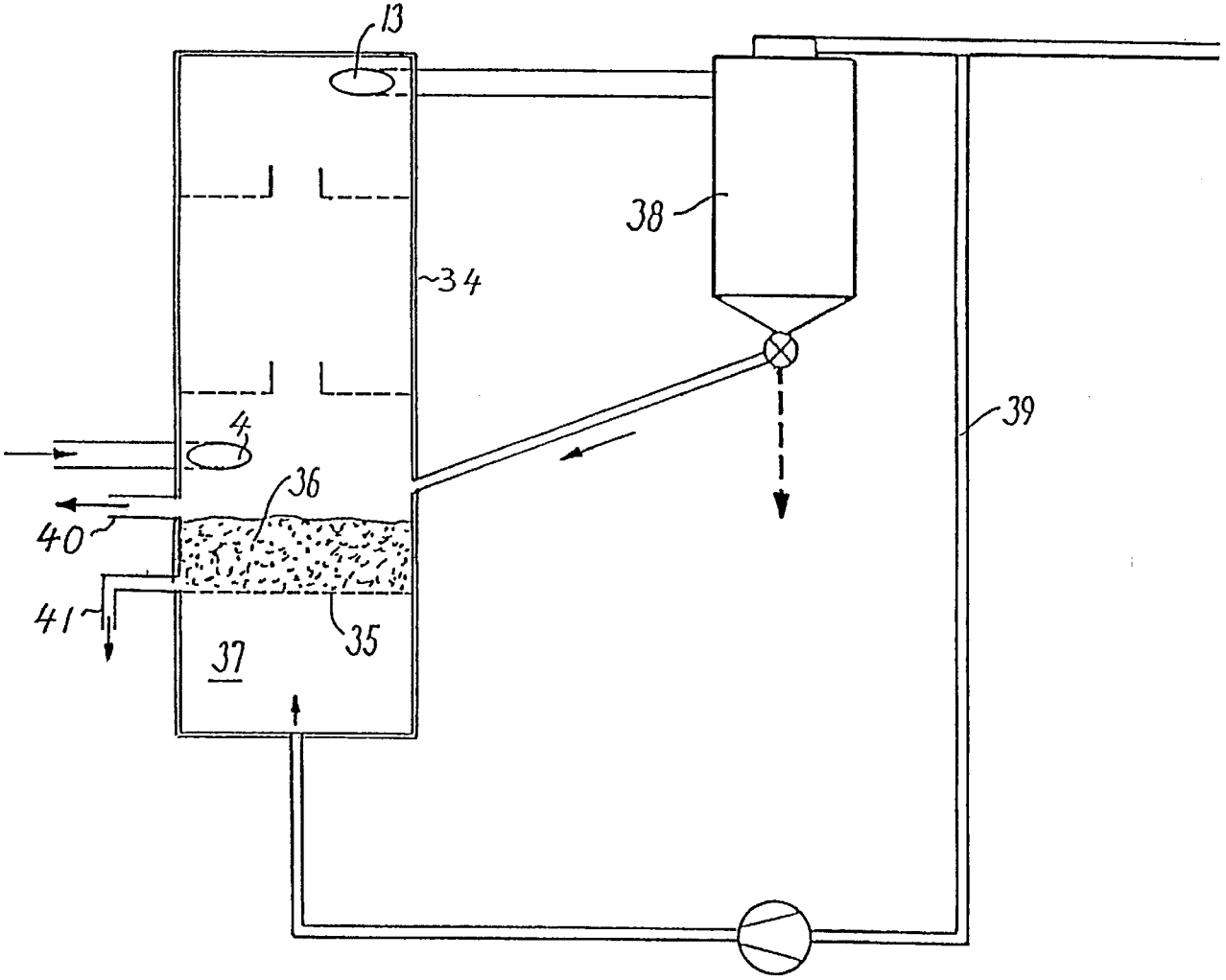
FIG. 5 is a schematic vertical sectional view of an embodiment of the apparatus according to the invention, also showing a lay-out for a suitable operation of such an embodiment in connection with a particle collector.

FIG. 5 depicts a further embodiment of an apparatus according to the invention and also shows an external flow system suitable for operating the apparatus. In this figure 34 designates a housing the upper part of which has the same equipment as the embodiment shown in FIG. 1 including an inlet 4 for drying gas and entrained moist particles.

Below said inlet a perforated plate 35 is provided for maintaining a fluidized particle layer 36.

Below the perforated plate 35 is a plenum 37 to receive and distribute fluidizing air to the perforated plate.

The outlet opening 13 from the apparatus is connected to a particle collector 38 such as a bag house or a cyclone.

The particles collected in 38 are at least partially conducted to the fluidized particle layer 36 and a partial stream 39 of the drying gas, freed from particulate materials, in the collector is conducted to the plenum 37 and used as fluidization gas in the fluidized layer 36. When fluidized in the layer the particles are in further drying contact with the same drying gas, by which it was previously entrained, and a very efficient and energy saving total drying operation is obtained. To obtain a very flexible operation heating means can be provided for reheating the partial drying gas stream 39 and heating elements such as heating panels can be inserted in the fluidized layer 36.

Above the fluidized layer 36 an annular baffle plate may be inserted (not shown), for example similar to the baffle plate 27 shown in FIG. 3, to avoid disturbance of the fluidized layer by the flow of drying air introduced through 4.

On the drawing in FIG. 5 the dotted arrow from the bottom of 38 indicates that it might be desired to withdraw a portion of the particles collected in the particle collector, in case the amount of dust particles circulating in the system becomes too high. The thus withdrawn portion of particles may be mixed with the product powder.

From the layer 36 the dried material are removed through an exit 40.

The maintenance of The fluidized layer 36 in the bottom portion of the apparatus involves the further advantage of facilitating withdrawal of the lumps and other non-dispersible particles from the system. Lumps may be removed from the bottom of the fluidized layer through 41.

It is to be understood that several other combinations of the embodiments shown in the FIGS. 1–5 can be made besides those already mentioned above.

The advantages obtainable by means of the present invention is further substantiated by means of the following example, which comprises a comparison with prior art.

EXAMPLE

Operation was performed using a test apparatus in principle designed as indicated in FIG. 3 followed by a cyclone. The apparatus had the following dimensions:

| | |
|---|---|
| Total height | 1280 mm |
| Diameter of housing | 290 mm |
| Diameter of the apertures 9 and 10 | 100 mm |
| Diameter of the inlet duct for supplying drying gas with entrained particles and of the outlet duct 13 | 100 mm |
| Height of the walls 9 and 10 | 80 mm |
| Distance from the ceiling of the housing to the periphery of the non-perforated baffle plate 27 | 200 mm |
| Distance from said periphery to the perforated plate 6 and distance between the two perforated plates | 340 mm |

Each of the gill-plates consists of four sections, all directing the passing gas and particle stream in directions having a component tangential to the cylindrical housing wall, and sustaining the swirling movement caused by the tangential inlet and outlet openings of the housing.

The material to be dried was s-PVC suspended in drying air from a flash dryer. The amount of dry product was approximately 50 kilogram/h and the amount of drying air approximately 700 kilogram/h.

Tests were conducted using various outlet temperatures from the drying gas leaving the cyclone, and the residual moisture content in the powder recovered from the cyclone were monitored.

Figure 6:
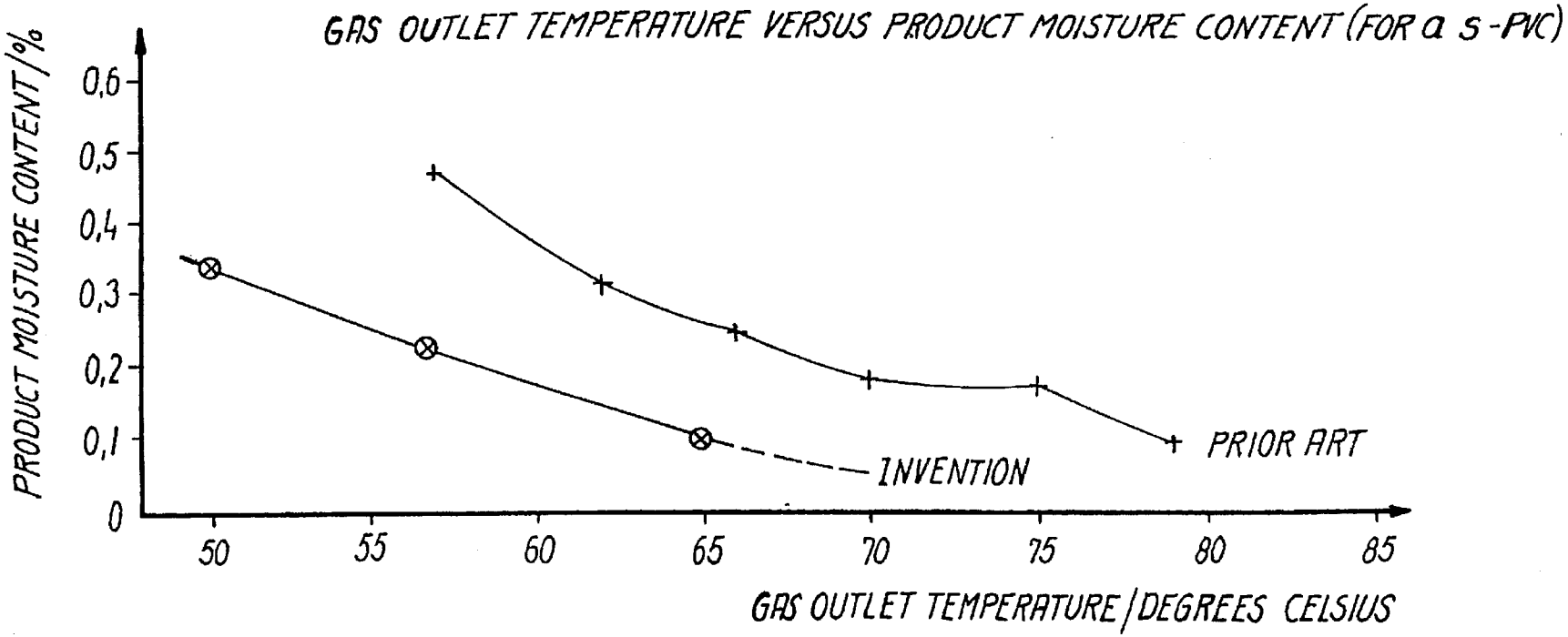
FIG. 6 shows graphs illustrating the relationship between drying gas outlet temperature and product moisture content for a specific s-PVC grade when using a prior art apparatus and an apparatus according to the invention, resp, as further explained in the Example below.

The results appear from the graph in FIG. 6.

Comparison tests were performed using the same apparatus, but having each of the perforated plates 5 and 6 substituted by two non-perforated plates of prior art design, that means plates similar to the one indicated as 27 in FIG. 3.

This means that in the comparison apparatus a total of 5 non-perforated annular baffle plates were arranged. The distance between each of said plates was 170 mm.

The operational details were exactly as those used in the above described apparatus according to the invention.

Also the results of the comparison tests appear from FIG. 6. Said figure shows that the drying obtained using an apparatus according to the invention having only two perforated, fluidized bed supporting plates plus one non-perforated plate is substantially more efficient than what is obtained by means of a prior art apparatus having five non-perforated plates.

What we claim is:

1. An apparatus for drying a moist material dispersed or dispersible in a stream of drying gas, comprising; a housing; supplying means in the lower part of said housing for drying gas and material to be dried, said supplying means having at least one common inlet opening for supplying drying gas entraining the moist material, wherein in the housing above said supplying means at least one substantially horizontal perforated plate, the perforations of which are dimensioned to allow an upward passage of a portion of the drying gas with entrained material therethrough sufficient to maintain a fluidized particle layer on the upper side of said plate when operating the apparatus, the periphery of said plate substantially being in sealing contact with the housing; for each perforated plate at least one by-pass means from a location below the plate to a location above the plate for passage of that portion of the drying gas with entrained material which has not passed through said perforations; and in the upper part of the housing above said at least one perforated plate, outlet means for discharging the drying gas entraining the material with reduced moisture content.

2. An apparatus according to claim 1, wherein the housing comprises a substantial vertical, substantially cylindrical wall.

3. An apparatus according to claim 2, wherein the means for supplying drying gas is tangential to the cylindrical wall.

4. An apparatus according to claim 2, wherein the means for supplying drying gas is tangential to the cylindrical wall and the outlet means is tangential to the cylindrical wall in the same sense of rotation as the tangential means for supplying drying gas.

5. An apparatus according to claim 1, further comprising a second perforated plate.

6. An apparatus according to claim 1, wherein said by-pass means is at least one aperture in the perforated plate.

7. An apparatus according to claim 6, wherein said at least one aperture is surrounded by a substantially vertical wall on the upper side of the perforated plate.

8. An apparatus according to claim 1, wherein said by-pass means is an external duct outside the housing connecting the area below the plate to the area above the plate.

9. An apparatus according to claim 1, wherein said by-pass means comprises at least one aperture in the perforated plate and at least one duct outside the housing connecting the area below the plate with the area above the plate.

10. An apparatus according to claim 1, wherein said by-pass means is provided with means for adjusting the flow of gas with entrained particles therethrough.

11. An apparatus according to claim 10, wherein the means for adjusting the gas flow is a damper or orifice plate regulating the passage through an aperture in the perforated plate or through an external by-pass means.

12. An apparatus according to claim 1, wherein at least one impediment plate is arranged to impede that part of the flow of gas and particles through the apparatus, which passes through the by-pass means, said impediment plate preferably being adjustable during the operation of the apparatus.

13. An apparatus according to claim 1, wherein said perforated plate is a gill-plate imparting a horizontal component to the direction of the flow of gas and particles penetrating the perforations of the plate.

14. An apparatus according to claim 13, wherein the housing comprises a substantially vertical, substantially cylindrical wall, and said gill-plate directs the penetrating flow tangentially to the cylindrical wall.

15. An apparatus according to claim 2, wherein the means for supplying drying gas is tangential to the cylindrical wall and said perforated plate is a gill-plate, which directs the penetrating flow tangentially in the same sense of rotation as the rotation created by the tangential supplying means for drying gas.

16. An apparatus according to claim 1, wherein said means for supplying drying gas and material to be dried comprises at least one inlet opening for drying gas, and above said opening a separate inlet for moist material to be dried, which apparatus further has rotatable mechanical means for dispersing the moist material into the drying gas, arranged in the housing at level with or below the opening for inlet of moist material.

17. An apparatus according to claim 1 further comprising a horizontal perforated gas distribution plate below said means for supplying drying gas and material; means for introducing fluidizing gas below the gas distribution plate; means for introducing particulate material above the gas distribution plate to enable maintenance of a fluidized layer on the gas distribution plate; and means for recovering dried particulate material from said fluidized layer.

18. A process for drying a moist material comprising; feeding a supplying means in a lower part of a housing with drying gas and material to be dried; conducting a stream of drying gas entraining material having reduced moisture content from an outlet means in an upper part of the housing to a particle collector device; conducting recovered particles from said particle collector device to a means for introducing particulate material above the gas distribution plate; conducting a partial stream of drying gas freed from particulate material from said particle collector device to the means for introducing fluidizing gas below the gas distribution plate, thereby forming a fluidized layer using the spent drying gas as fluidizing gas for further utilization of the drying capacity thereof; and recovering of a dried particulate material from said fluidized layer.

19. A process for drying a moist material using an apparatus as defined in claim 18, wherein the material to be dried is selected from the group consisting of polymers, s-PVC or ABS, silica, pigments and starch products.

20. An apparatus for drying a moist material dispersed or dispersible in a stream of drying gas, comprising; a housing; supplying means in the lower part of said housing for drying gas and material to be dried, said supplying means comprising at least one inlet opening for drying gas and at least one inlet for moist material to be entrained in the drying gas after introduction into said housing; wherein in the housing above said supplying means at least one substantially horizontal perforated plate, the perforations of which are dimensioned to allow an upward passage of a portion of the drying gas with entrained material therethrough sufficient to maintain a fluidized particle layer on the upper side of said plate when operating the apparatus, the periphery of said plate substantially being in sealing contact with the housing; for each perforated plate at least one by-pass means from a location below the plate to a location above the plate for passage of that portion of the drying gas with entrained material which has not passed through said perforations; and in the upper part of the housing above said at least one perforated plate, outlet means for discharging the drying gas entraining the material with reduced moisture content.

21. An apparatus according to claim 20, wherein the housing comprises a substantial vertical, substantially cylindrical wall.

22. An apparatus according to claim 21, wherein the means for supplying drying gas is tangential to the cylindrical wall.

23. An apparatus according to claim 21, wherein the means for supplying drying gas is tangential to the cylindrical wall and the outlet means is tangential to the cylindrical wall in the same sense of rotation as the tangential means for supplying drying gas.

24. An apparatus according to claim 20, further comprising a second perforated plate.

25. An apparatus according to claim 20, wherein said by-pass means is at least one aperture in the perforated plate.

26. An apparatus according to claim 25, wherein said at least one aperture is surrounded by a substantially vertical wall on the upper side of the perforated plate.

27. An apparatus according to claim 20, wherein said by-pass means is an external duct outside the housing connecting the area below the plate to the area above the plate.

28. An apparatus according to claim 20, wherein said by-pass means comprises at least one aperture in the perforated plate and at least one duct outside the housing connecting the area below the plate with the area above the plate.

29. An apparatus according to claim 20, wherein said by-pass means is provided with means for adjusting the flow of gas with entrained particles therethrough.

30. An apparatus according to claim 29, wherein the means for adjusting the gas flow is a damper or orifice plate regulating the passage through an aperture in the perforated plate or through an external by-pass means.

31. An apparatus according to claim 20, wherein at least one impediment plate is arranged to impede that part of the flow of gas and particles through the apparatus, which passes through the by-pass means, said impediment plate preferably being adjustable during the operation of the apparatus.

32. An apparatus according to claim 20, wherein said perforated plate is a gill-plate imparting a horizontal component to the direction of the flow of gas and particles penetrating the perforations of the plate.

33. An apparatus according to claim 32, wherein the housing comprises a substantially vertical, substantially cylindrical wall, and said gill-plate directs the penetrating flow tangentially to the cylindrical wall.

34. An apparatus according to claim 21, wherein the means for supplying drying gas is tangential to the cylindrical wall and said perforated plate is a gill-plate, which directs the penetrating flow tangentially in the same sense of rotation as the rotation created by the tangential supplying means for drying gas.

35. An apparatus according to claim 20, wherein said means for supplying drying gas and material to be dried comprises at least one inlet opening for drying gas, and above said opening a separate inlet for moist material to be dried, which apparatus further has rotatable mechanical means for dispersing the moist material into the drying gas, arranged in the housing at level with or below the opening for inlet of moist material.

36. An apparatus according to claim 20, further comprising a horizontal perforated gas distribution plate below said means for supplying drying gas and material; means for introducing fluidizing gas below the gas distribution plate; means for introducing particulate material above the gas distribution plate to enable maintenance of a fluidized layer on the gas distribution plate; and means for recovering dried particulate material from said fluidized layer.

* * * * *